US009103181B2

(12) United States Patent
Invierno

(10) Patent No.: US 9,103,181 B2
(45) Date of Patent: Aug. 11, 2015

(54) HEATER CABLE FOR TUBING IN SHALE TYPE HYDROCARBON PRODUCTION WELLS EXPOSED TO HIGH PRESSURES AND WELLS WITH ANNULAR SPACE FLOODED EVENTUALLY OR PERMANENTLY OR A COMBINATION OF BOTH

(71) Applicant: Pablo Javier Invierno, Ciudad Autonoma de Buenos Aires (AR)

(72) Inventor: Pablo Javier Invierno, Ciudad Autonoma de Buenos Aires (AR)

( * ) Notice: Subject to any disclaimer, the term of this patent is extended or adjusted under 35 U.S.C. 154(b) by 347 days.

(21) Appl. No.: 13/685,809

(22) Filed: Nov. 27, 2012

(65) Prior Publication Data

US 2013/0140018 A1 Jun. 6, 2013

(30) Foreign Application Priority Data

Dec. 1, 2011 (AR) ..... P110104464

(51) Int. Cl.
*E21B 36/04* (2006.01)
*E21B 36/00* (2006.01)
*H05B 3/56* (2006.01)

(52) U.S. Cl.
CPC ..... *E21B 36/00* (2013.01); *E21B 36/04* (2013.01); *H05B 3/565* (2013.01); *H05B 2203/021* (2013.01); *H05B 2214/03* (2013.01)

(58) Field of Classification Search
CPC ..... E21B 36/003; E21B 36/04; H01B 3/28; H01B 3/00; H05B 3/56; H05B 3/565
See application file for complete search history.

(56) References Cited

U.S. PATENT DOCUMENTS

| | | | | | |
|---|---|---|---|---|---|
| 3,757,086 | A | * | 9/1973 | Indoe | 219/528 |
| 4,152,577 | A | * | 5/1979 | Leavines | 392/468 |
| 4,242,573 | A | * | 12/1980 | Batliwalla | 219/528 |
| 4,523,086 | A | * | 6/1985 | Eilentropp | 219/549 |
| 4,631,392 | A | * | 12/1986 | O'Brien et al. | 219/549 |
| 5,065,818 | A | | 11/1991 | Van Egmond | |
| 5,182,792 | A | | 1/1993 | Goncalves | |
| 5,394,507 | A | * | 2/1995 | Okamoto | 392/480 |

(Continued)

FOREIGN PATENT DOCUMENTS

| | | |
|---|---|---|
| AR | 039993 | 3/2005 |
| ES | 8700534 | 1/1987 |

(Continued)

*Primary Examiner* — Kenneth L Thompson
(74) *Attorney, Agent, or Firm* — Defillo & Associates, Inc.; Evelyn A. Defillo

(57) ABSTRACT

A heater cable for hydrocarbon drilling tubing, preferably applicable to pressurized or flooded annular space shale type wells, to prevent and/or remove obstructions in petroleum production wells tubing, caused by the accumulation of substances such as paraffin and hydrates or by a sharp increase in viscosity of the type which extends alongside a metallic thermo conductor duct affixed to the tubing by means of fixation elements. The cable is formed by an inner sheath insulating the electrical conductors, a metallic coat on said conductors' insulating sheath, a fluoropolymeric jacket surrounding said metallic sheath and an outer armor generally defined by a spring which surrounds the jacket in a helicoidal way. The coating of the conductors' insulating sheath is defined by a laminar band which protects all the surface of said sheath arranged in a surrounding way alongside it following a helicoidal arrangement and whose successive spirals are partially overlapped between them. According to a preferred embodiment, said laminar band is formed by an outer aluminum sheath and an inner polymeric sheath.

7 Claims, 2 Drawing Sheets

(56) References Cited

U.S. PATENT DOCUMENTS

| | | | | |
|---|---|---|---|---|
| 5,713,415 | A * | 2/1998 | Bridges | 166/60 |
| 5,782,301 | A | 7/1998 | Neuroth et al. | |
| 6,142,707 | A | 11/2000 | Bass et al. | |
| 6,144,018 | A * | 11/2000 | Heizer | 219/529 |
| 6,536,526 | B2 * | 3/2003 | Cox | 166/302 |
| 6,564,011 | B1 * | 5/2003 | Janoff et al. | 392/480 |
| 6,680,465 | B2 * | 1/2004 | O'Connor | 219/544 |
| 7,989,740 | B2 * | 8/2011 | Whitney et al. | 219/549 |
| 2002/0023751 | A1 * | 2/2002 | Neuroth et al. | 166/302 |
| 2005/0109753 | A1 * | 5/2005 | Jones | 219/213 |
| 2010/0059502 | A1 * | 3/2010 | O'Connor | 219/505 |

FOREIGN PATENT DOCUMENTS

| | | |
|---|---|---|
| WO | WO9208036 | 5/1992 |
| WO | WO0011317 | 3/2000 |
| WO | WO0127437 | 4/2001 |

* cited by examiner

HEATER CABLE FOR TUBING IN SHALE TYPE HYDROCARBON PRODUCTION WELLS EXPOSED TO HIGH PRESSURES AND WELLS WITH ANNULAR SPACE FLOODED EVENTUALLY OR PERMANENTLY OR A COMBINATION OF BOTH

FIELD OF THE INVENTION

The present invention refers to a heater cable used in hydrocarbon production tubing in shale type wells, exposed to high pressures, and wells with annular space eventually or permanently flooded, or a combination of both. The cable is also suitable for vertical or directional wells, wells without pressure, dry annular wells, and any other production system with high operative flexibility in a wide range of variables. The purpose of this heater cable is to prevent and/or unblock obstructions in the tubing of hydrocarbon production wells caused by the accumulation of substances such as paraffin and hydrates and to reduce the rate of high oil viscosity, which makes the oil production more difficult or impossible and it is especially useful when said oil and cable are exposed to temperatures lower than the cloud point or pour point or below a reasonable viscosity limit and exposed to high pressures, say, higher than 1000 psi and even over 10,000 psi.

STATE OF THE ART AND PROBLEMS TO BE SOLVED

The largest oil reserves are of the heavy or high viscosity type. In the composition of this type of oil, there is usually a high content of high molecular weight hydrocarbons (or low API degrees). Besides, the fluid can also contain paraffin which at low temperatures forms solids which tends to obstruct the tubing. In general, these problems do not happen simultaneously, since when the crude oil is light and with low viscosity, it is not difficult to be produced but it usually contains paraffin, which tends to generate solids that precipitate obstructing the tubing. When the crude oil is heavy, it usually does not contain paraffin but the viscosity curve proper to this type of oil generates a problem. In this case, there are no precipitating solid components but these low temperatures, according to the relationship in the viscosity curve, make the oil viscosity to increase significantly reaching points very near to the solidification point. This situation can cause obstructions in the tubing and although, if it did not reach this critical point, the increase of the oil viscosity might mean that it has to be produced at a very low flow so as not to damage the equipment and it might cause the pumping to be interrupted because of it becoming extremely difficult or impossible to pump, if not cause complete failure.

It is also known that there is an inverse relationship between the hydrocarbons' temperature and the viscosity. In fact, as the temperature drops, their viscosity increases until it turns into a paste and reaches an almost solid state. If the temperatures between the deepest areas of the earth and those closest to the surface are compared, it can be observed that the values drop in proportion to the depth. That is, the closer to the surface, the lower the temperature and hence when the oil production is done from the geological layers where it is found, on its way up it goes through areas with lower and lower temperatures. To sum it up, in some types of oil, the loss of temperature implies having to overcome the admissible viscosity limit because of the counter pressure generated. The increase in the viscosity, due to cooling, generates enormous drag which can stop the production of wells or produce the pumps failure if this is made artificially. Even in this last case, the production is reduced as time passes or it cannot be generated in full.

In wells with a high content of paraffin, its precipitation blocks or obstructs the well making it unproductive with an effect similar to the one described above.

In natural gas wells, the formation of hard structured hydrates can block the drilling tubing in the same way as the paraffin.

In all these cases, the problem is the temperature drop, while the counterpart solution is to prevent it from dropping below the appropriate limits for each well in particular.

Besides, it is worth mentioning that the reserves of shale type hydrocarbons, which could not be exploited a short time ago, can be added to the global reserves of crude oil. Nevertheless, with the technical advances they have now become commercially viable and their potential is enormous. It is worth mentioning that with the advance in these new types of wells, apart from the problems with temperature mentioned above which are typical of all wells, there are new variables to the equation such as the pressure which is an important problem since all the current cables do not resist high pressure operations. As an example, the shale type wells on many occasions are produced with high pressure and usually during their installation or even during their operation, the areas where the heater cables are installed are exposed to very high pressures which make it necessary to develop a special design to resist said pressures, not only eventually, but also on a permanent basis. This happens even with the use of packers since the losses and the high annular pressure that help keep them in position are not unusual.

It is also usual for the sector, where the heater cable is installed, to be flooded with very high density solutions to block the well while the installation is made and said situation does not change during a later operation, since it is normal for the fluids to stay in that position or that part or all the crude oil drilled goes up along that sector where the heater cable is situated. This implies that the heater cable must endure high pressures and be submerged in chemically aggressive fluids, such as the case of the cable which is the object of the present invention.

As some previous arts on the subject, the following documents can be cited as summarized below:

The ES 8700534 document refers to a procedure and a cable to heat the field surrounding the exploration well. The cable used is flexible since it is introduced from coils and does not form a fixed installation system with rigid pieces fixable to drilling tubing.

The WO 92/08036 document refers to a special heater cable where the heating effect is obtained by means of a short-circuit between its core and one of the superficial sheaths. It does not refer to a device or equipment which includes different means of mounting and installation.

The WO 01/27437 and RU 2182959 documents refer to a device or equipment for the introduction of a heater cable within the drilling tubing. It refers to a device containing a sheave and means to introduce or remove the cable from the production tubing whose aim is to introduce or remove the cable rather than to compose a fixed installation of a heating system.

The WO 00/11317 document refers to a heater cable which includes fiber optic conductors. This fiber optic makes it possible to take the well's temperature, and for this reason, it is also used to detect the existence of fluid because of the presence of temperature differences.

The U.S. Pat. No. 6,142,707 document discloses a tubing-in-tubing heating system inducing currents between the external and internal tubing.

The U.S. Pat. No. 5,782,301 document refers to a heater cable to provide three phase power which is directly applied to the tubing since there is no external duct. Its structure is mainly made of lead. In practice, the cables with this type of structures have caused many failures and they only support low heating powers and require very high currents for which reason they are not quite suitable for high viscosity or high pressure oil production and they are nothing but adapted, feeding cables for electro submergible pumps.

The U.S. Pat. No. 5,182,792 document discloses some equipment or device which instead of insulating the electrical piece in the tubing, produces a short-circuit between an internal cable and the tubing itself where the cable is introduced. It refers to a system which is applicable to tubing in general rather than to installation for oil wells.

The U.S. Pat. No. 5,065,818 document refers to a heater which is fixed to the concrete walls of non-tubed wells.

The U.S. Pat. No. 4,911,239 document refers to a pump heater which heats the input of the pump producing a short-circuit between the pumping tree and the wall of the production tubing.

Finally it is worth mentioning Utility Model AR039993B4 referred to a heater cable for petroleum production tubing which "comprises a combination of an outer metal thermal conductor and a flexible inner sheath with electrically insulating, anticorrosion properties and mechanical resistance where said sheath is formed by several overlapping sheaths which include: a) one electrically insulating inner sheath which surrounds the electrical conductors, feeding the heater elements connected to said conductors alongside the device; b) a second meshed metallic sheath which covers the first sheath; c) a third fluoropolymeric sheath which surrounds the second sheath; and d) an outer armour sheath which surrounds the third sheath. Although this heater cable under definite conditions fulfils its function, when it is subjected to high pressures inside the hydrocarbon production well, it presents some structural and functional deficiencies. It means that through the holes of the metallic mesh, the high pressures cause the deformation of the insulating sheath which protects the electrical conductors, affecting in this way the dielectric ability of said insulating sheath, which seems even more notorious due to the chemical effects of the fluid which filters between the mesh and the insulating sheath. Besides, the metallic mesh is permeable to radio frequencies for which reason, due to its own current flow, it can generate interferences with other cables or instruments used inside the well.

With the state-of-the-art technology it is common for wells, independently from the problem of viscosity, paraffin or hydrates, to be exploited to extremes never imagined before and they are usually high pressure wells, such as for example, the shale-like wells which have recently developed in the world. All this makes it necessary for all the accessories and devices used in the production process to be more resistant and the old-fashioned tools and designs are not enough to reach those goals. Consequently, it is necessary to develop new highly resistant elements, such as the cable, which is the object of the present invention.

ADVANTAGES TO THE INVENTION

In order to solve the inconveniences mentioned above with regard to the conventional heater cables to prevent or eliminate the paraffin solidification and the consequent partial or total blockage of the well tubing for hydrocarbon production, the cable in the present invention has been developed. In fact, the structural characteristics of this cable which make it different from the ones used so far, transforms it in an efficient solution to the problems mentioned above since they define a barrier against the pressures it has to endure maintaining the protection of the electrical conductivity and its insulating sheath which enables to maintain in due course the cable's optimum conditions, even in the presence of high pressures or of fluids inside the annular space. Besides, another remarkable advantage consists of the fact that it allows the dissipation of the temperature in such a way that the conductors remain within the normal parameters because of the current going along them. Besides, it is worth mentioning that the conductors are completely armoured against radio frequencies. An additional advantage is that it allows a continuous operation and at the maximum power. Its high mechanic resistance makes it suitable to be placed even inside the tubing, resisting the pressures applied to it. The installation of the cable inside the tubing can be made in wells with electrical-submergible pumping or with gas lift, but it would not be compatible with mechanical pumping methods. The external fixing to the tubing has no limitations at all. At the same time, the higher resistance of this cable enables it to be placed in slanted wells or even horizontal wells, heating not only the fluid but also the surrounding formation to improve its flow to the well.

SUMMARY OF THE INVENTION

The object of the present invention is to count with a heater cable for high flexibility operation, in order to be used or exchanged in wells with very different characteristics, since it can be installed either in a shale or in an ordinary, vertical or horizontal well with high or low pressure and with a flooded or non-flooded annular space, combining all these variables and resisting a wide spectrum of fluids, which are chemically and physically aggressive, unified in a highly versatile, single product very suitable for the user (a petroleum company). There is no doubt that the particular development of this heater cable is suitable for high pressure and flooded annular shale wells, being this its special strength, but it can also be used in all kinds of wells with fewer requirements.

For this reason it is the object of the present invention to provide a heater cable for hydrocarbon drilling tubing preferably applicable to pressurized or flooded annular space, shale type wells, destined to prevent and/or unblock tubing obstructions in the tubing of petroleum production wells caused by the accumulation of substances such as paraffin and hydrates and the reduction of viscosity in wells with high viscosity crude, especially at critically low temperatures of the type that extends along a metallic thermo conductor duct fixed to the tubing by means of fixing elements. The cable is formed by an inside sheath which insulates the electrical conductors, a metallic sheath for said electrical conductors insulating sheath, a fluoropolymeric surrounding jacket of said metallic sheath and an external armour generally defined by a spring which surrounds the jacket in a helicoidal form. The sheath of the conductors' insulating sheath is defined by a protective laminar band which covers all the surfaces of said insulating sheath in a surrounding way alongside it following a helicoidal development and whose successive spires are partially overlapped between them. According to a preferred embodiment, said laminar band is composed of an outer aluminium sheath and an inner polymeric sheath.

BRIEF DESCRIPTION OF THE FIGURES

For further clarity and understanding of the present invention, it is shown in different figures in which it is represented according to the preferred embodiments only as an example.

DETAILED DESCRIPTION OF THE INVENTION

Figure 1:
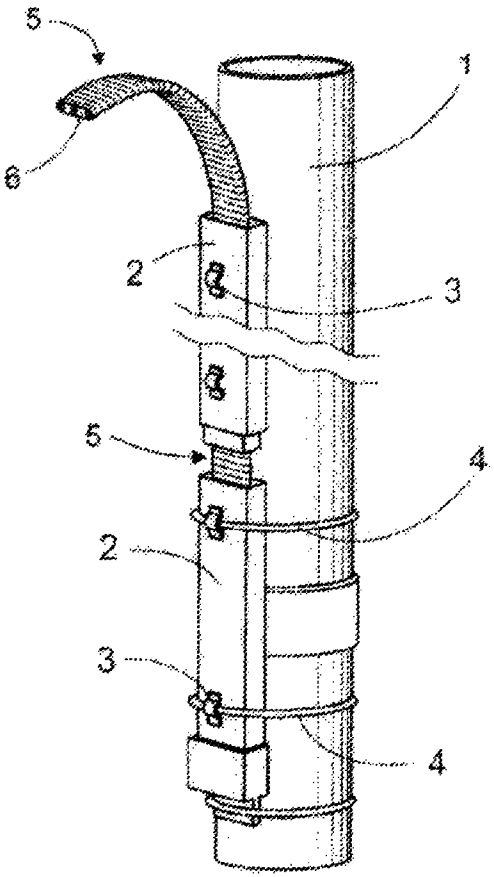
FIG. 1 is a perspective front view of a heater cable of the present invention showing a hydrocarbon drilling tubing section where thermo conductor ducts have been fixed and the heater cable is running through the duct.

FIG. 1 shows a typical tubing (1) for the drilling of hydrocarbons arranged in a production well. The heater exchanges defined by metallic thermo conductor ducts (2) are arranged on the tubing (1) by means of mounting elements (3) and clamps (4). The heating cable (5) passes through the thermo conductor ducts (2) In this embodiment includes the heating cable (5) that shows three electrical conductors (6).

Figure 2:
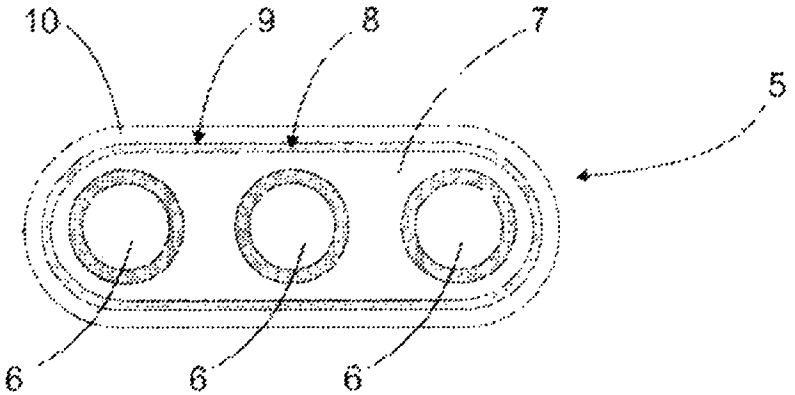
FIG. 2 is a cross-sectional view of the heater cable of FIG. 1.
Figure 3:
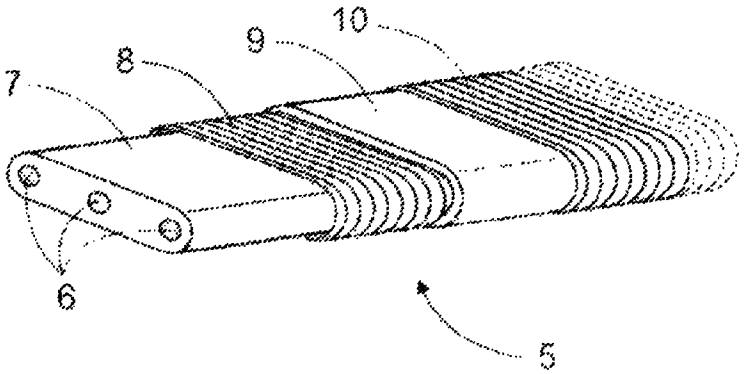
FIG. 3 is a perspective front view of the heater cable of FIG. 1 showing different structural sheaths.

In FIGS. 2 and 3, it can be appreciated in detail that the heater cable (5) includes an inside sheath (7) insulating the conductors (6), a metallic band (8) wound around said insulating sheath (7), a fluoropolymeric jacket (9) surrounding the metallic band (8), and an outside armour sheath (10) defined by a band twisted around the fluoropolymeric jacket (9). The metallic band (8) protects all the surfaces of the insulating sheath (7) and it wound following a helicoidal arrangement.

Figure 4:
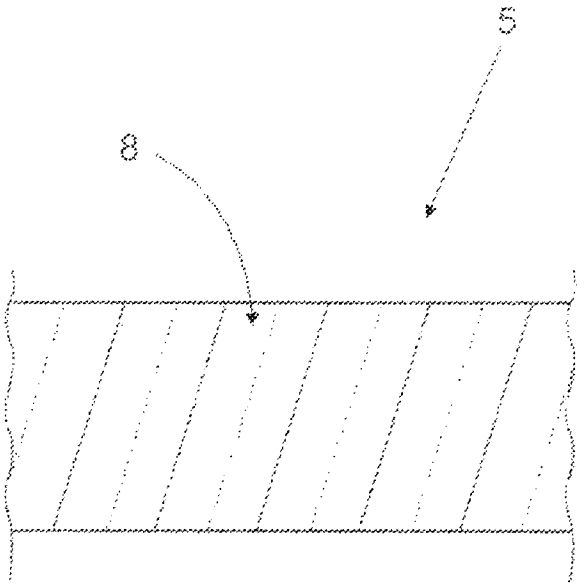
FIG. 4 is a scheme of the form in which a protective sheath of the insulating sheath of the cable's electrical conductors is arranged.

As shown in FIG. 4, the successive spirals of the band (8) are partially overlapped with each other, for example, between 10% and 90% of its width, although according to the preferred embodiment, said spirals are overlapped in about 50% of its width.

Figure 5:
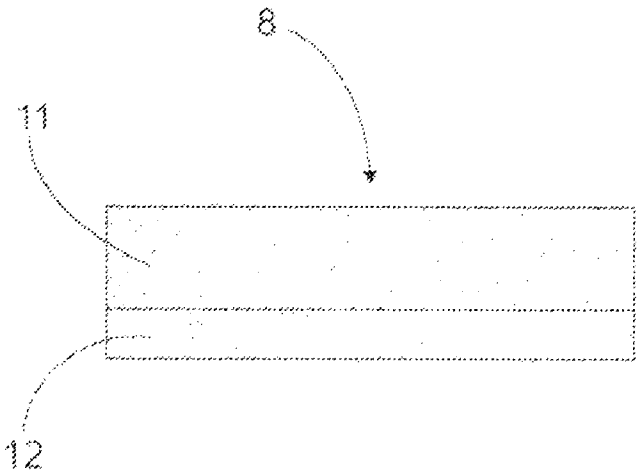
FIG. 5 shows a scheme of the form in which the protective sheath in FIG. 4 is shown and how it is arranged on the insulating sheath of the cable conductors.

FIG. 5 shows that the band (8) is preferably formed by an aluminium outer sheath (11) and an inner sheath (12) of a polymeric material such as polyethylene terephthalate (Mylar or Melinex as per their trade names). Optionally, the outer sheath (11) of the band (8) could also be made of copper, but since this material tends to rust in the short or medium term reducing the cable's useful life, it is used only under certain circumstances or applications.

In an alternative embodiment not shown here, in practice, the thermo conductor metallic duct (15) might be affixed to at least one rod arranged in the interior of the production tubing (1) in a substantially axial position by means of mounting and fixing devices. In this way, the metallic conduct defines a means of direct heat exchange with the fluid transported by the production tubing since said conduct (15) is not in contact with the production tubing (1) but with the fluid flowing in its interior.

Having in this way specially described and determined the nature of the present invention and the form to be taken into practice, the following is claimed to be of my exclusive right and property:

What is claimed is:

1. A heater cable for a hydrocarbon drilling tubing, the heater cable comprising:
- at least one metallic thermo conductor duct adapted to be attached to the hydrocarbon drilling tubing
- the heater cable is adapted to be passed through at least one metallic thermo conductor duct, the heater cable having a flexible body including:
- a plurality of insulating conductors;
- an inner sheath wrapping the insulating conductors;
- a metallic band wound around said inner sheath in a helicoidal winding;
- a fluoropolymeric jacket surrounding said metallic band;
- an outer armour sheath surrounding said fluoropolymeric jacket in a helicoidal winding; and
- wherein successive spirals of said metallic band overlap between each other in at least 10% and 90% of a width of the metallic band.

2. The heater cable according to claim 1, wherein the successive spirals of said metallic band are overlapped in 50% of the width of the band.

3. The heater cable according to claim 1, wherein said metallic band is made of aluminium.

4. The heater cable according to claim 1, wherein said metallic band is formed by an outer copper sheath and an inner polymeric sheath.

5. A heater cable for a hydrocarbon drilling tubing, the heater cable comprising:
- at least one metallic thermo conductor duct adapted to be attached to the hydrocarbon drilling tubing;
- the heater cable is adapted to be passed through at least one metallic thermo conductor duct, the heater cable having a flexible body including:
- a plurality of insulating conductors;
- an inner sheath wrapping the insulating conductors;
- a metallic band wound around said inner sheath in a helicoidal winding;
- a fluoropolymeric jacket surrounding said metallic band;
- an outer armour sheath surrounding said fluoropolymeric jacket in a helicoidal winding; and
- wherein said metallic band is made by an outer aluminium sheath and a polymeric inner sheath.

6. The heater cable according to claim 5, wherein said inner sheath is made of polyethylene terefthalate.

7. A heater cable for a hydrocarbon drilling tubing, the heater cable comprising:
- at least one metallic thermo conductor duct adapted to be attached to the hydrocarbon drilling tubing;
- the heater cable is adapted to be passed through at least one metallic thermo conductor duct, the heater cable having a flexible body including:
- a plurality of insulating conductors;
- an inner sheath wrapping the insulating conductors;
- a metallic band wound around said inner sheath in a helicoidal winding;
- a fluoropolymeric jacket surrounding said metallic mesh;
- an outer armour sheath surrounding said fluoropolymeric jacket in a helicoidal winding; and
- a double laminar band with corresponding spirals partially overlapped between them.

* * * * *